United States Patent [19]

Otteson

[11] 4,103,639

[45] Aug. 1, 1978

[54] GUN CHAMBER INDICATOR

[76] Inventor: Nelson Stuart Otteson, 6724 Caneel Ct., Springfield, Va. 22152

[21] Appl. No.: 780,990

[22] Filed: Mar. 24, 1977

[51] Int. Cl.[2] ..... F41C 27/12; G08B 5/02

[52] U.S. Cl. ..... 42/1 D; 116/114 AL

[58] Field of Search ..... 116/114 AL; 42/1 D

[56] References Cited

U.S. PATENT DOCUMENTS 439,551 10/1890 Pheatt ..... 42/1 D

FOREIGN PATENT DOCUMENTS 126,409 11/1945 Australia ..... 42/1 D 371,852 8/1921 Fed. Rep. of Germany ..... 42/1 D

*Primary Examiner*—Daniel M. Yasich

[57] ABSTRACT

Mechanical means for determining the presence of a cartridge in the chamber of a locked firearm in which a biased plunger means cooperates with the movement of the firearm eject or to indicate absence or presence of a cartridge therein.

10 Claims, 3 Drawing Figures

GUN CHAMBER INDICATOR

BACKGROUND AND SUMMARY

The broad concept of a mechanical device to allow positive verification, by feel and by vision, of the presence of a cartridge in the chamber of a locked firearm is not new. Previous devices, however, have involved an undesirable compromise to the strength or the reliability of the firearm. Most have utilized a separate plunger-type probe, positioned either parallel to or normal to the centerline of the chamber. In either case, this probe has constituted an additional penetration weakening the system which supports the cartridge case, adding to those already necessitated by the feed, extraction, and ejection functions of the breech mechanism. A few approaches have involved the extractor, an already existing component, but in so doing have complicated its construction to a degree which undermines its efficiency, reliability, and cost of manufacture.

The present invention provides a direct, reliable, and inexpensive mechanical means to indicate the status of the chamber of a locked firearm, a means which does not require an additional probe to penetrate the walls of the firearm which support the cartridge case against expansion and failure from firing pressure, and does not impair the function of an existing component.

The spring-plunger type of ejector, originally introduced in the U.S. service arms of World War II, is now applied almost universally in modern high-power firearms due to its simplicity and its compatibility with breech systems giving maximum support and confinement to the cartridge case structure of modern high-pressure ammunition. It is the object of this invention to utilize, with minimal alteration to its design and function, this type of ejector as the probe for a chamber indicator. This use of this type of ejector as a probe does not significantly effect its construction, functioning, or reliability. During the closing and locking phase of the breech bolt into the receiver of a firearm, the plunger-type ejector is cammed back into the breech bolt body by the cartridge, normally a distance, parallel to the chamber axis, of about one-eighth of an inch. It is the object of this invention to utilize this displacement of the ejector plunger, by means of a very simple mechanical train, to actuate an indicator to protrude beyond an exterior surface of the firearm where it can be seen and felt. When the chamber is empty, the ejector plunger is not cammed back into the breech bolt, and the indicator means is caused by its return spring to lie substantially flush with an exterior surface of the firearm.

The specific embodiment described herein involves the application of this invention to the class of firearm breech mechanism well known in the art as the "bolt action". The embodiment is further shown restricted to the most common type of bolt action used for high-power cartridges, the Mauser type wherein the breech bolt is machined or fabricated into a one-piece body, without a separate, non-rotary, breech bolt head, so that all elements of the breech bolt body rotate together. This particular embodiment has been chosen to illustrate the invention because it represents by far the most difficult type of firearm breech mechanism to which the invention can be adapted, since the breech bolt, which houses the ejector, performs rotary, helical, and longitudinal movement relative to the receiver, which can house the indicator, during each complete operational sequence of this type of firearm.

DRAWINGS

DESCRIPTION

Figure 1:
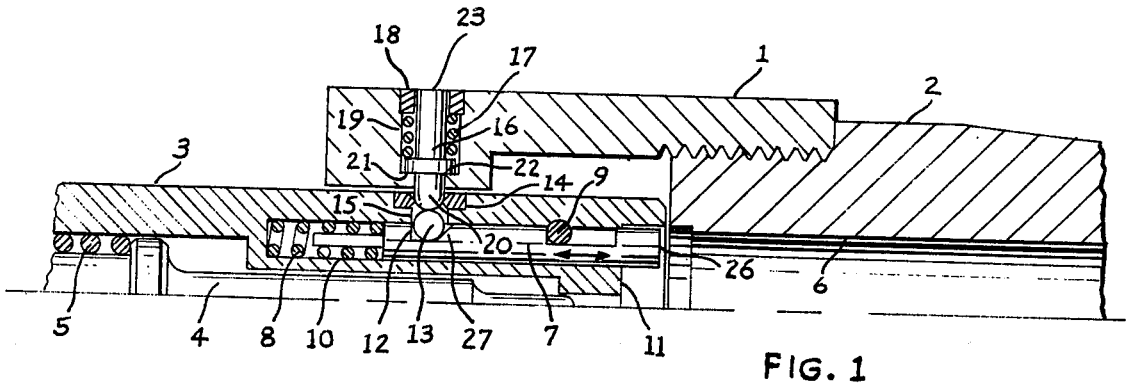
FIG. 1 is a partial longitudinal section looking 45° downward and showing the elements of a bolt action firearm embodying the invention, with the breech bolt shown in the locked position, the firing pin cocked, and an empty chamber.

Referring to FIG. 1, the firearm shown embodying the invention is the well known bolt action type, comprising a receiver 1 to which a barrel 2 is secured, and a substantially cylindrical breech bolt 3 of one-piece construction and with a projecting handle at the rear (not shown) for manual manipulation. The breech bolt 3 is mounted within the receiver 1 to the rear of and in axial alignment with the barrel 2. Locking means (not shown) are formed on the breech bolt 3 and receiver 1 to allow the receiver 1, breech bolt 3, and barrel 2 to form a complete breeching system capable of supporting a cartridge during the firing process.

Contained within the breech bolt 3 is a firing pin 4 and mainspring 5 which form a portion of the ignition unit, intended to ignite a cartridge in the chamber 6, and controlled by a trigger assembly (not shown). Also contained within, or attached to, the breech bolt 3 is an extractor (not shown) for extracting cartridges from the chamber 6 on bolt opening, and an ejector assembly 7, 8 and 9 to eject cartridges clear of the firearm upon completion of the opening cycle of the breech bolt 3.

The ejector assembly comprises a plunger 7, actuating spring 8, and retaining cross pin 9, and is housed in a cavity 10 which runs parallel to the axis of the chamber and opens into the cartridge support face 11 of the breech bolt 3. This construction maintains the ejector plunger 7 in a fixed angular position, while allowing a limited axial movement to perform the ejection function. This type of firearm also includes such major components as a stock, magazine, and trigger guard, which do not bear upon the invention and thus are not shown in the drawings.

All elements and functions described thus far are conventional and well known to those skilled in the art. Elements comprising the invention, and also shown in FIG. 1, are an indicator camming recess 12, an indicator ball 13, an indicator ball retaining bushing 14, and an indicator ball cavity 15, all formed within, or contained within, the breech bolt 3, and an indicator plunger 16, indicator plunger return spring 17, indicator plunger retaining bushing 18, and indicator plunger cavity 19, all formed within, or contained within, the receiver 1.

As shown in FIG. 1, when the breech bolt 3 is in the locked position and the chamber 6 is empty, the ejector plunger 7 is extended forward in the axial direction, under the pressure of its actuating spring 8, to the full forward limit allowed by its retaining cross pin 9. In this condition, the indicator camming recess 12 is positioned to allow the indicator ball 13 to recess a maximum distance within the breech bolt 3. In the breech-bolt-locked position, the indicator plunger 16 is aligned with the indicator ball retaining bushing 14 so that when the chamber 6 is empty and the indicator ball 13 is in the maximum recessed position, the lower nose 20 of the indicator plunger 16 is allowed to enter the indicator ball retaining bushing 14 under the pressure of the indicator plunger return spring 17 until it reaches the position shown in FIG. 1 with the indicator plunger flange 21 bottomed out against the counterbore 22 of the indicator plunger cavity 19. In this position the upper nose 23 of the indicator plunger 16 is shown to be substantially flush with the exterior surface of the receiver 1, thus providing a signal, both visually and by feel, to the shooter that the chamber 6 of the locked firearm is empty.

Figure 2:
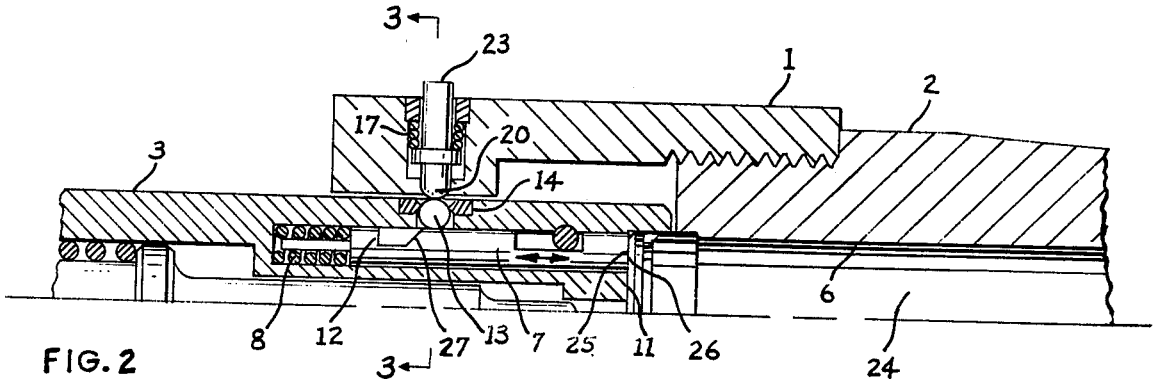
FIG. 2 is another partial longitudinal section looking 45° downward (as defined by line 2 — 2 of FIG. 3) and showing the elements of a bolt action firearm embodying the invention, with the breech bolt shown in the locked position, the firing pin cocked, and a cartridge in the chamber.

FIG. 2 shows the position of the elements of the invention when the breech bolt 3 is in the closed and locked position and there is a cartridge 24 in the chamber 6. The base 25 of the cartridge 24 has forced the ejector plunger 7 rearward against its actuating spring 8 until its nose 26 lies substantially flush with the cartridge support face 11 of the breech bolt 3. As shown in FIG. 2, this rearward movement of the ejector plunger 7 causes an inclined plane 27 on the indicator camming recess 12 to cam the indicator ball 13 out further from the centerline of the breech bolt 3 to a position substantially flush with the exterior surface of the breech bolt 3. The lower nose 20 of the indicator plunger is in turn forced, against the pressure from its return spring 17, out of its recessed position in the indicator ball retaining bushing 14, until its upper nose 23 protrudes substantially from the exterior surface of the receiver 1. This protrusion serves as a positive and infallible indication, readily sensed by the shooter both via vision and feel, that the chamber 6 of the firearm contains a cartridge.

Figure 3:
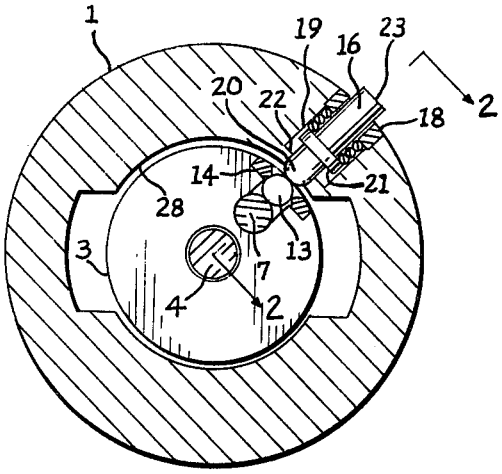
FIG. 3 is a cross sectional view of the entire receiver ring area, taken at the longitudinal position defined by line 3 — 3 of FIG. 2.

By utilizing an existing functional element, the ejector assembly, as the probe, this indicator system does not introduce a new or additional violation or penetration of the cartridge support system, the chief objection to previous chamber indicator systems. Nor, as can be readily seen from the figures and description, is there introduced any deleterious effect to the construction or function of the ejector system. In order to accomplish the preceding, the indicator assembly is located back from the immediate chamber area, to the breech bolt and receiver area. Thus, elements of the indicator system must be located in both the breech bolt and the receiver in a manner to insure they can cooperate to transmit probe movement out to an exterior portion of the firearm where it can be interrupted by the shooter. In the bolt-action embodiment described herein, provisions must be included so that the indicator train can never impede or jam the one-piece breech bolt as it moves within the receiver during its various operational phases. The means shown in FIGS. 1 – 3 to insure this constitute the provision of proper shapes, dimensions, and relative proportions for all elements and cavities, particularly the indicator ball retaining bushing 14, indicator ball 13, and the lower nose 20 of the indicator plunger 16, so that the indicator ball 13 will at all times cam inward at least flush with the exterior surface of the breech bolt 3 without jamming or binding its operation, and so that the lower nose 20 of the indicator plunger 16 always does the same relative to the breech-bolt well 28 of the receiver 1.

As will be apparent to those skilled in the art, the scope of the invention described herein is not limited to the specific embodiment used for illustration. Nor is it limited in application to the type of bolt action firearm described herein. It is equally applicable to other forms of firearm breech mechanisms, as well as to variations of the bolt action, such as those with non-rotary bolt heads. In fact, the elements of the invention could be simplified in these latter instances where the movement between the head of the breech bolt and the receiver is less complex. Also, within the scope of the invention, protrusion of the indicator directly from the body of the breech bolt, rather than from the receiver, could be utilized. As is obvious from the description herein, this would entail exactly the same principles, except with the elements of the indicator train assuming substantially simplified form, since the intermediate or transfer portion of the indicator train could be eliminated.

I claim:

1. In a firearm, a breech bolt and a receiver, said breech bolt moving within said receiver from an unlocked and open position to a closed and locked position, and vice-versa, a barrel secured to a front portion of said receiver, a rear portion of said barrel containing a chamber, a head portion, said head portion being at the front part of said breech bolt and cooperating with said chamber when said breech bolt is in the closed and locked position to contain and support a cartridge when the cartridge is inserted into said chamber of said barrel, a spring-powered ejector means fitted into said head of said breech bolt to eject the cartridge from said firearm by spring power if the bolt is moved from the closed and locked position to the unlocked and open position, the improvement comprising a mechanical indicator means for determining the presence or the absence of a cartridge in said chamber of said firearm when said breech bolt is in said closed and locked position, said indicator means operationally coacting with said ejector means, said ejector means functioning as the probe for said indicating means for determining the presence or absence of a cartridge in said chamber, said indicator means being moveable to an indicating position by said ejector means in response to the presence of a cartridge in said chamber.

2. An indicator means according to claim 1, wherein the closing and locking of said breech bolt into said receiver imparts a displacement to said ejector means parallel to its axis when said chamber contains a cartridge, said axial displacement moving said indicator means to an indicating position.

3. An indicator means according to claim 1, wherein the closing and locking of said breech bolt into said receiver imparts a displacement to said ejector means parallel to its axis when said chamber contains a cartridge, said axial displacement moving said indicator means outward to an indicating position.

4. An indicator means according to claim 1, wherein the closing and locking of said breech bolt into said receiver imparts a displacement to said ejector means parallel to its axis when said chamber contains a cartridge, said axial displacement moving said indicator means outward to a protruding position, or a position of increased protrusion, from an exterior surface of said firearm.

5. An indicator means according to claim 1, wherein the closing and locking of said breech bolt into said receiver imparts a displacement to said ejector means parallel to its axis when said chamber contains a cartridge, said axial displacement moving said indicator means outward to a protruding position, or a postion of increased protrusion, from an exterior surface of said receiver.

6. An indicator means according to claim 1, wherein the closing and locking of said breech bolt into said receiver imparts a displacement to said ejector means parallel to its axis when said chamber contains a cartridge, said axial displacement moving said indicator means outward to an indicating position by means of an inclined plane formed on said ejector means.

7. An indicator means according to claim 1, wherein the closing and locking of said breech bolt into said receiver imparts a displacement to said ejector means parallel to its axis when said chamber contains a cartridge, an element fitted into the wall of said breech bolt, said element which is acted upon by an inclined plane formed on said ejector means to translate axial displacement of said ejector means into an outward movement of said indicator means to an indicating position.

8. An indicator means according to claim 1, wherein the closing and locking of said breech bolt into said receiver imparts a displacement to said ejector means parallel to its axis when said chamber contains a cartridge, a first element fitted into the wall of said breech bolt and a second element fitted into the wall of said receiver, said first element which is acted upon by an inclined plane formed on said ejector means to translate axial displacement of said ejector means into outward movement, said outward movement of said first element causing an outward movement of said second element to an indicating position.

9. An indicator means according to claim 1, wherein the closing and locking of said breech bolt into said receiver imparts a displacement to said ejector means parallel to its axis when said chamber contains a cartridge, a first element fitted into the wall of said breech bolt and a second element fitted into the wall of said receiver, said first element which is acted upon be an inclined plane formed on said ejector means to translate axial displacement of said ejector means into outward movement, said outward movement of said first element causing an outward movement of said second element to a protruding position, or a position of increased protrusion, from an exterior surface of said receiver.

10. An indicator means according to claim 1, wherein the closing and locking of said breech bolt into said receiver imparts a displacement to said ejector means parallel to its axis when said chamber contains a cartridge, an entrapped ball fitted into the wall of said breech bolt, a radial plunger fitted into the wall of said receiver, and a spring fitted into the wall of said receiver to resiliently bias said radial plunger inward to a position substantially flush with an exterior surface of said receiver, said entrapped ball which is acted upon by an inclined plane formed on said ejector means to translate axial displacement of said ejector means into outward movement, said outward movement of said entrapped ball causing outward movement of said radial plunger from a position substantially flush with an exterior surface of said receiver to a protruding position, or a position of increased protrusion, from an exterior surface of said receiver.

* * * * *